US012280295B2

(12) United States Patent
Leroux

(10) Patent No.: US 12,280,295 B2
(45) Date of Patent: Apr. 22, 2025

(54) EXERCISE APPARATUS

(71) Applicant: Julien Leroux, Sainte-Agathe-des-Monts (CA)

(72) Inventor: Julien Leroux, Sainte-Agathe-des-Monts (CA)

( * ) Notice: Subject to any disclaimer, the term of this patent is extended or adjusted under 35 U.S.C. 154(b) by 161 days.

(21) Appl. No.: 18/167,286

(22) Filed: Feb. 10, 2023

(65) Prior Publication Data

US 2023/0256295 A1 Aug. 17, 2023

Related U.S. Application Data

(60) Provisional application No. 63/309,180, filed on Feb. 11, 2022.

(51) Int. Cl.

| | |
|---|---|
| ***A63B 23/04*** | (2006.01) |
| ***A63B 21/00*** | (2006.01) |
| ***A63B 21/06*** | (2006.01) |

(52) U.S. Cl.

CPC .... *A63B 23/0405* (2013.01); *A63B 21/00065* (2013.01); *A63B 21/0615* (2013.01); *A63B 21/4033* (2015.10); *A63B 21/4047* (2015.10); *A63B 2023/0411* (2013.01); *A63B 2208/0228* (2013.01)

(58) Field of Classification Search

CPC ..... A63B 23/0405; A63B 21/00065; A63B 21/0615; A63B 21/4047; A63B 21/4033; A63B 2208/0228; A63B 2208/0233; A63B 2023/0411

See application file for complete search history.

(56) References Cited

U.S. PATENT DOCUMENTS

| | | | |
|---|---|---|---|
| 4,111,414 | A | 9/1978 | Roberts |
| 4,846,458 | A | 7/1989 | Potts |

(Continued)

FOREIGN PATENT DOCUMENTS

| | | | |
|---|---|---|---|
| CN | 108144263 | A | 6/2018 |
| CN | 210963723 | U | 7/2020 |

(Continued)

OTHER PUBLICATIONS

Heffernan, C., The History of the Assisted Pull Up Machine, Physical Culture Study, Jan. 4, 2019, https://physicalculturestudy.com/2019/01/04/the-history-of-the-assisted-pull-up-machine/.

*Primary Examiner* — Joshua T Kennedy
(74) *Attorney, Agent, or Firm* — BCF LLP

(57) ABSTRACT

An exercise apparatus including a base, a support extending from the base, a lever, at least one seat arm and a seat is disclosed. The lever, which is pivotally connected to the support about a first horizontal pivot axis, has first and second portions extending on, respectively, first and second sides of the first horizontal pivot axis. The at least one seat arm upper portion and lower portions connected to, respectively, the first portion and the seat. The seat is pivotally connected to the first portion about a second horizontal pivot axis, which is parallel to the first horizontal pivot axis, via the at least one seat arm. The lever selectively pivots about the first horizontal pivot axis between first and second positions, the seat being higher in the first position than in the second position, and the lever being biased toward the first position.

20 Claims, 8 Drawing Sheets

(56) References Cited

U.S. PATENT DOCUMENTS

| | | | | |
|---|---|---|---|---|
| 5,322,489 | A * | 6/1994 | Webb | A63B 21/068 482/133 |
| 5,372,556 | A | 12/1994 | Ropp | |
| 5,722,921 | A * | 3/1998 | Simonson | A63B 21/4033 482/137 |
| 6,702,724 | B2 * | 3/2004 | Taylor | A63B 23/0405 482/52 |
| 7,247,128 | B2 | 7/2007 | Oga | |
| 9,375,607 | B1 | 6/2016 | Rayman et al. | |
| 10,456,614 | B1 | 10/2019 | Dube et al. | |
| 10,870,046 | B2 * | 12/2020 | Franklin | A63B 71/0622 |
| 11,117,017 | B2 | 9/2021 | Rayman | |
| 2005/0227826 | A1 * | 10/2005 | Oga | A63B 21/00181 482/92 |
| 2008/0039297 | A1 * | 2/2008 | Steinmetz | A63B 23/0222 482/100 |
| 2018/0036589 | A1 * | 2/2018 | Lin | A63B 21/4035 |
| 2018/0296879 | A1 | 10/2018 | Blium et al. | |
| 2019/0083845 | A1 | 3/2019 | Bouldstridge Balari | |
| 2023/0201657 | A1 * | 6/2023 | Rayman | A63B 23/0405 482/137 |

FOREIGN PATENT DOCUMENTS

| | | | |
|---|---|---|---|
| CN | 112972199 | A | 6/2021 |
| TW | I610703 | B | 1/2018 |

* cited by examiner

EXERCISE APPARATUS

CROSS-REFERENCE TO RELATED APPLICATION

The present application claims priority to U.S. Provisional Patent Application No. 63/309,180, filed Feb. 11, 2022 entitled "Exercise Apparatus", the entirety of which is incorporated by reference herein.

FIELD OF TECHNOLOGY

The present technology relates to exercise apparatuses.

BACKGROUND

Many people perform rehabilitation exercises in order to strengthen weakened muscles. This is notably common after suffering from injuries or following certain surgeries. To this end, there are some exercise apparatuses that can be used to aid in the rehabilitation exercises.

Conventional exercise apparatuses for lower body exercises can hinder the form of the person using the exercise apparatus and can be limiting in the range of exercises that can be performed thereon.

In view of the foregoing, there is a need for an exercise apparatus that addresses at least some of these drawbacks.

SUMMARY

It is an object of the present technology to ameliorate at least some of the inconveniences present in the prior art.

The present technology relates to an exercise machine that can assist a user to perform lower body exercises such as squats. The exercise machine has a seat that is suspended from a lever which is biased towards an initial position. When the user squats, a posterior of the user engages the seat, making the seat go down and pivoting the lever. Since the lever is biased toward the initial position, the seat is biased in an upward direction, thereby assisting the user while squatting by reducing load borne by muscles of the user.

According to an aspect of the present technology, there is provided an exercise apparatus including a base, a support extending upward from the base, a lever, at least one sear arm and a seat. The lever is pivotally connected to the support about a first horizontal pivot axis, and has a first portion extending at least in part on a first side of the first horizontal pivot axis, and a second portion extending at least in part on a second side of the first horizontal pivot axis. The at least one seat arm has an upper portion connected to the first portion of the lever. The seat is connected to a lower portion of the at least one seat arm, and is pivotally connected to the first portion of the lever about a second horizontal pivot axis via the at least one seat arm, the second horizontal pivot axis being parallel to the first horizontal pivot axis. The lever selectively pivots about the first horizontal pivot axis between a first position and a second position, the seat being higher in the first position of the lever than in the second position of the lever. The lever is biased toward the first position.

In some embodiments, the upper portion of the at least one seat arm is pivotally connected to the first portion of the lever about the second horizontal pivot axis.

In some embodiments, the first portion of the lever has a first lever arm and a second lever arm, the at least one seat arm includes a first seat arm connected to the first lever arm and a second seat arm connected to the second lever arm, the seat is connected to the lower portions of the first and second seat arms, and the seat is disposed between the first and second seat arms.

In some embodiments, the exercise apparatus further includes two handles connected to one of the first portion of the lever and the seat.

In some embodiments, the two handles are connected to the first portion of the lever.

In some embodiments, the exercise apparatus further includes a biasing assembly operatively connected to the second portion of the lever for biasing the lever toward the first position.

In some embodiments, the second portion of the lever is operatively connected to the biasing assembly by a pulley system.

In some embodiments, the biasing assembly is a counterweight assembly.

In some embodiments, the counterweight assembly is disposed on the first side of the horizontal pivot axis, and to a side of the seat.

In some embodiments, a vertical distance between a top of the seat and the first portion of the lever is selectively adjustable.

In some embodiments, the exercise apparatus further includes a stopper for stopping the lever at the second position.

In some embodiments, the stopper is selectively adjustable to adjust a location of the second position.

In some embodiments, the stopper abuts the first portion of the lever when the lever reaches the second position.

In some embodiments, the stopper extends upward from the base.

In some embodiments, the base has a first base portion, a second base portion and a third base portion, the second base portion being arcuate and extending between the first and third base portions. The first, second and third base portions define a U-shape.

In some embodiments, a distance between the first and second base portions is greater than a width of the seat.

In some embodiments, the support extends generally vertically from a fourth base portion that is generally perpendicular to the first and third base portions.

In some embodiments, the first portion has an intermediate member extending generally parallel to the first horizontal pivot axis, the second portion has a third arm and a fourth arm, and the third and fourth arms are connected to the intermediate member and to one another for generally defining a triangle.

In some embodiments, the seat is pivotally connected to the lower portion of the at least one arm about a third horizontal pivot axis.

In some embodiments, the seat includes at least one abutting pin for limiting the pivoting range of motion of the seat about the third horizontal pivot axis.

Embodiments of the present technology each have at least one of the above-mentioned objects and/or aspects, but do not necessarily have all of them. It should be understood that some aspects of the present technology that have resulted from attempting to attain the above-mentioned object may not satisfy this object and/or may satisfy other objects not specifically recited herein.

It must be noted that, as used in this specification and the appended claims, the singular form "a", "an" and "the" include plural referents unless the context clearly dictates otherwise.

As used herein, the term "about" in the context of a given value or range refers to a value or range that is within 20%, preferably within 10%, and more preferably within 5% of the given value or range.

As used herein, the term "and/or" is to be taken as specific disclosure of each of the two specified features or components with or without the other. For example "A and/or B" is to be taken as specific disclosure of each of (i) A, (ii) B and (iii) A and B, just as if each is set out individually herein.

In the context of the present specification, unless expressly provided otherwise, the words "first", "second", "third", etc. have been used as adjectives only for the purpose of allowing for distinction between the nouns that they modify from one another, and not for the purpose of describing any particular relationship between those nouns.

For purposes of the present application, terms related to spatial orientation when referring to an exercise apparatus and components in relation to the exercise apparatus, such as "vertical", "horizontal", "forwardly", "rearwardly", "left", "right", "above" and "below", are as they would be understood by a user of the exercise apparatus as the user is about to use the exercise apparatus, with the exercise apparatus resting on a flat, level surface.

Additional and/or alternative features, aspects and advantages of embodiments of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
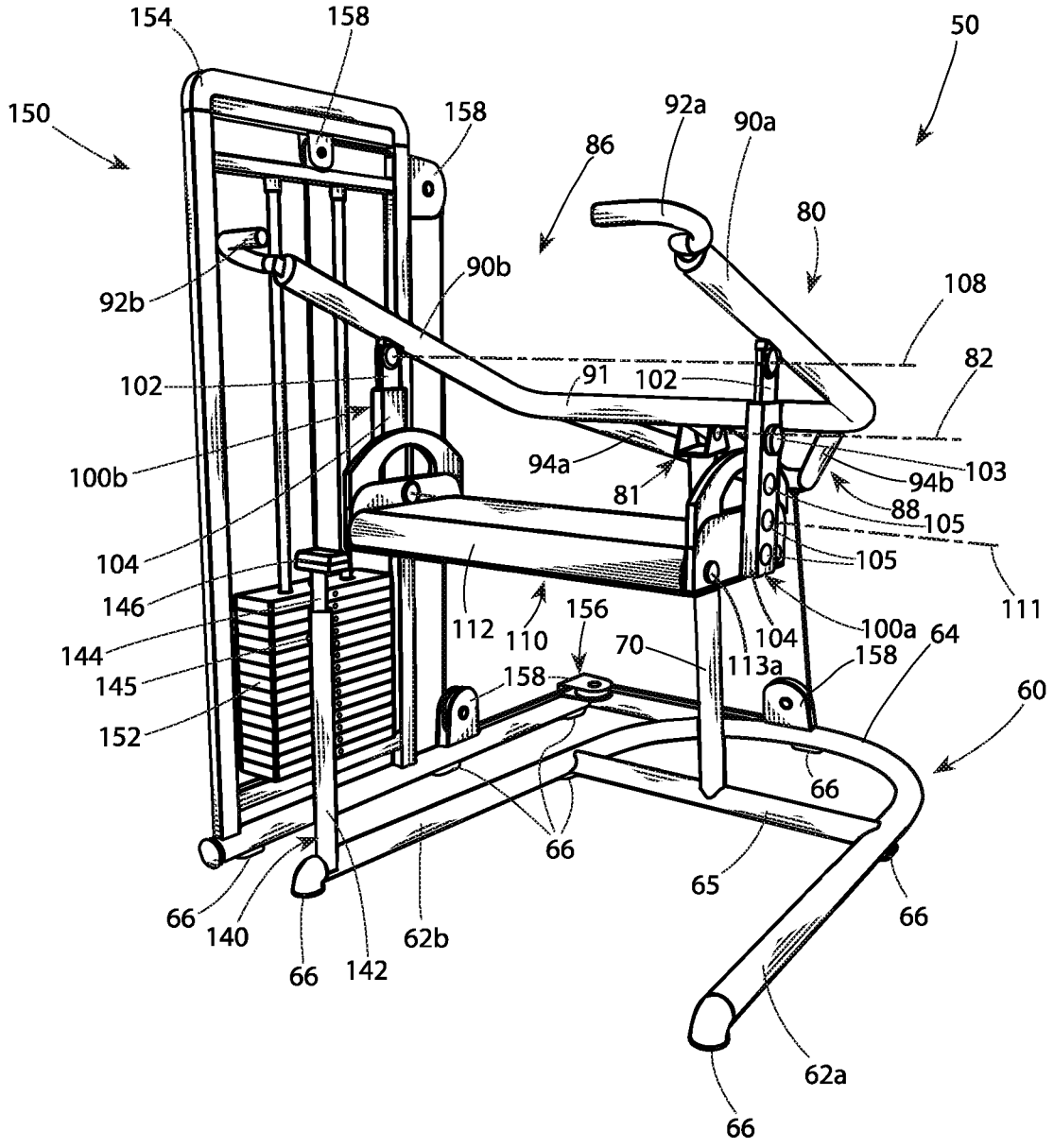
FIG. 1 is a perspective view taken from a front, top, left side of an exercise apparatus according to an embodiment of the present technology.

The present disclosure is not limited in its application to the details of construction and the arrangement of components set forth in the following description or illustrated in the drawings. The disclosure is capable of other embodiments and of being practiced or of being carried out in various ways. Also, the phraseology and terminology used herein is for the purpose of description and should not be regarded as limiting. The use of "including", "comprising", or "having", "containing", "involving" and variations thereof herein, is meant to encompass the items listed thereafter as well as, optionally, additional items. In the following description, the same numerical references refer to similar elements.

In accordance with the present technology, there is provided an exercise apparatus 50 that can assist a user 52 in performing various lower body exercises.

Figure 2:
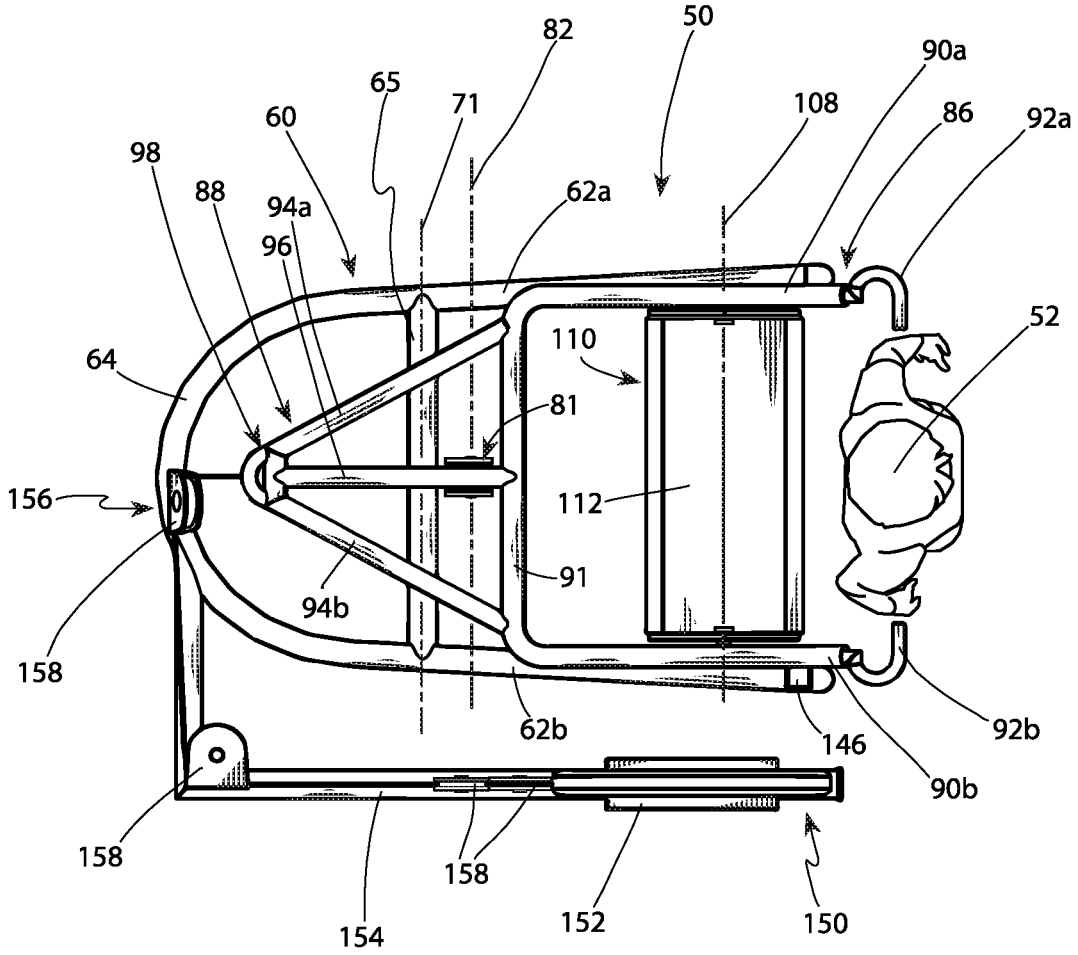
FIG. 2 is a top plan view of the exercise apparatus of FIG. 1 with a user standing in front of the exercise apparatus.

Referring to FIGS. 1 and 2, the exercise apparatus 50 has a base 60. The base 60 has left and right base portions 62*a*, 62*b*, an intermediate base portion 64 that is arcuate and that extends between the left and right base portions 62*a*, 62*b* and a central base portion 65 that extends generally perpendicular to the left and right base portions 62*a*, 62*b* and that is disposed longitudinally forward from the intermediate base portion 64. It is contemplated that in other embodiments, the base 60 could include more or fewer frame portions. As seen from above, the left, right and intermediate base portions 62*a*, 62*b*, 64 generally define a U-shape. The U-shape helps to provide a stable base to the exercise apparatus 50. Additionally, as will be described in greater detail below, the left and right base portions 62*a*, 62*b* are spaced so as to provide clearance for feet of the user 52 and/or for equipment. In other embodiments, the left, right and intermediate base portions 62*a*, 62*b*, 64 could define another shape. The base 60 also has feet 66 disposed between the base 60 and a resting surface (surface upon which the exercise apparatus 50 is disposed). The feet 66 can help minimize and/or correct a level of the exercise apparatus 50.

The exercise apparatus 50 also includes a support 70 that extends upward from the base 60. More precisely, the support 70 extends generally vertically and longitudinally forward from the central base portion 65, such that the support 70 is angled relative to a vertical plane 71 (shown in FIGS. 2, 3A, 3B, 4A and 4B), which passes through a bottom of the support 70, by about ten degrees. In some embodiments, the support 70 could extend vertically such that the support 70 is parallel to the vertical plane 71. In other embodiments, the support 70 could extend generally vertically such that the support 70 is angled relative to the vertical plane 71 by about fifteen degrees. In other embodiments, the support 70 could be angled relative to the vertical plane 71 by more than fifteen degrees. It is also contemplated that instead of being oriented in an upward and forward direction, the support 70 could be oriented in an upward and rearward direction.

The exercise apparatus 50 further includes a lever 80 that is pivotally connected to a top of the support 70 about a horizontal lever pivot axis 82. The lever 80 is pivotally connected to the support 70 by a pivot assembly 81, which includes a shaft (not shown) and bearings (not shown). The pivot assembly 81 defines the lever pivot axis 82. The lever 80 includes a front lever portion 86 that extends on a front side of the lever pivot axis 82, and rear lever portion 88, a majority of which extends on a rear side of the lever pivot axis 82. As will be described in greater detail below, the lever 80 can pivot about the lever pivot axis 82 from an initial position (shown in FIGS. 3A, 4A, and 5A) to a lower position (shown in FIGS. 3B, 4B and 5B) and any positions therebetween. Generally, when the lever 80 is in the initial position, the front lever portion 86 is oriented in an upwards direction and the rear lever portion 88 is oriented in a downwards direction, and when the lever 80 is in the lower position, the front lever portion 86 is oriented in a downward direction and the rear lever portion 88 is oriented in a upwards direction. As will be described below, the lever 80 is biased toward the initial position.

With continued reference to FIGS. 1 and 2, the front lever portion 86 has a left lever arm 90*a*, a right lever arm 90*b* and an intermediate member 91. The intermediate member 91 extends laterally between the left and right lever arms 90*a*, 90*b* and is generally parallel to the lever pivot axis 82. As will be described below, it is contemplated that in some embodiments, the front lever portion 86 could be configured to only have a single lever arm. The left and right lever arms 90*a*, 90*b*, which are laterally spaced from one another, extend forward from the intermediate member 91. Thus, the left and right lever arms 90*a*, 90*b* also extend forward relative to the lever pivot axis 82. Left and right handles 92*a*, 92*b* are connected to front ends of the left and right lever arms 90*a*, 90*b*. The user 52 may hold on to the left and right handles 92*a*, 92*b* for assistance while using the exercise apparatus 50.

Turning now to the rear lever portion 88, which includes a left rear arm 94*a*, a right rear arm 94*b* and a middle rear arm 96. A front end of each of the left and right rear arms 94*a*, 94*b* is connected to the intermediate member 91, and the rear ends of the left and right rear arms 94*a*, 94*b* are connected to one another as well as to a rear end of the middle rear arm 96. As best seen in FIG. 2, the left and right rear arms 94*a*, 94*b* and the intermediate member 91 generally define a triangular shape. The middle rear arm 96, which is disposed laterally between the left and right rear arms 94*a*, 94*b*, is pivotally connected to the pivot assembly 81. The front end of the middle rear arm 96 is connected to the intermediate member 91, and the rear end of the middle rear arm 96 connects to the rear ends of the left and right rear arms 94*a*, 94*b*. The middle rear arm 96 is generally perpendicular to the intermediate member 91. At a rear end of the rear lever portion 88, the rear lever portion 88 defines a connecting segment 98. As will be described in greater detail below, the connecting segment 98 is configured to connect to a biasing assembly to bias the lever 80 toward the initial position.

With continued reference to FIGS. 1 and 2, the exercise apparatus 50 also includes left and right seat arms 100*a*, 100*b* which are connected to the front lever portion 86. Each of the left and right seat arms 100*a*, 100*b* includes an upper portion 102 and a lower portion 104 where the upper portion 102 is configured to be received in the lower portion 104 (i.e., each of the left and right seat arms 100*a*, 100*b* has a telescopic configuration). It is contemplated that in some embodiments, the lower portion 104 could be received in the upper portion 102. The upper portion 102 has a retractable pin 103 that is biased towards an extended position. The lower portion 104 defines four apertures 105 configured to receive the pin 103 therein. It is contemplated that in some embodiments, the lower portion 104 could define more or fewer than four apertures. A length of each of the left and right seat arms 100*a*, 100*b*, defined as being measured from a respective upper end of the upper portion 102 to a respective bottom end of the lower portion 104, is adjustable. To adjust the length of the left and right seat arms 100*a*, 100*b*, the retractable pins 103 are retracted. Then, the lower portions 104 are moved vertically up or vertically down, as desired, relative to the upper portions 102 until the retractable pins 103 are aligned with one of the apertures 105. When the retractable pins 103 are aligned with one of the apertures 105, since the retractable pins 103 are biased toward the extended position, the retractable pins 103 extend through the one of the apertures 105, thereby locking the upper portion 102 relative to the lower portion 104. It is contemplated that in some embodiments, the left and right seat arms 100*a*, 100*b* could not be telescopic arms.

The upper portion 102 of the left seat arm 100*a* is pivotally connected to the left lever arm 90*a*, and the upper portion 102 of the right seat arm 100*b* is pivotally connected to the right lever arm 90*b*. Since the left and right seat arms 100*a*, 100*b* are longitudinally aligned, the left and right seat arms 100*a*, 100*b* are both pivotally connected to the front lever portion 86 about a horizontal seat pivot axis 108. The seat pivot axis 108 is generally horizontal (i.e., parallel to the lever pivot axis 82).

The exercise apparatus 50 also includes a seat 110 that is connected to the lower portions 104 of the left and right seat arms 100*a*, 100*b*. The seat 110 is disposed between the lower portions 104 and is pivotable relative to the lower portions 104 about a seat pivot axis 111 that is generally horizontal (i.e., parallel to the lever pivot axis 82). The seat 110 includes a seat cushion 112. It is contemplated that in some embodiments, the left and right handles 92*a*, 92*b* could be connected to the seat 110 instead of the front ends of the left and right lever arms 90*a*, 90*b*. In other embodiments, the seat 110 could have handles in addition to the left and right handles 92*a*, 92*b*. The seat 110 further includes, on a left side thereof, a leading abutting pin 113*a* that is positioned longitudinally forward from the lower portion 104 of the left seat arm 100*a* and a trailing abutting pin 113*b* that is positioned longitudinally rearward from the lower portion 104 of the left seat arm 100*a*. It is contemplated that in some embodiments, the leading and trailing abutting pins 113*a*, 113*b* could be disposed on the right side of the seat 110. In other embodiments, the leading and trailing abutting pins 113*a*, 113*b* could be disposed on both lateral sides of the seat 110. The leading and trailing abutting pins 113*a*, 113*b* are for limiting a pivoting range of motion of the seat 110 about the seat pivot axis 111 by abutting the left seat arm 100*a* when the seat 110 pivots about the seat pivot axis 111 by a certain amount. As a result, the seat 110 is prevented from pivoting about the seat pivot axis 111 such that the seat cushion 112 faces downwardly. Adjusting the length of the left and right seat arms 100*a*, 100*b*, as described hereabove, results in adjusting a vertical distance between a top of the seat 110 and the front lever portion 86. This enables the exercise apparatus to accommodate for users of varying heights. As will be described in greater detail below, during use of the exercise apparatus 50, a posterior of the user 52 may rest on the seat 110.

The seat 110 is pivotally connected to the front lever portion 86 via the left and right seat arms 100*a*, 100*b*, such that the seat 110 is pivotable about the seat pivot axis 108. It is contemplated that in some embodiments, the upper portions 102 of the left and right seat arms 100*a*, 100*b* could be rigidly connected to the front lever portion 86, such that the seat 110 would pivot only about the seat pivot axis 111 that is vertically offset from the front lever portion 86. It is contemplated that in some embodiments, the seat 110 could be rigidly connected to the lower portions 104 of the seat arms 100*a*, 100*b*, and would therefore not be pivotable relative to the lower portions 104 of the seat arms 100*a*, 100*b*.

Figure 3A:
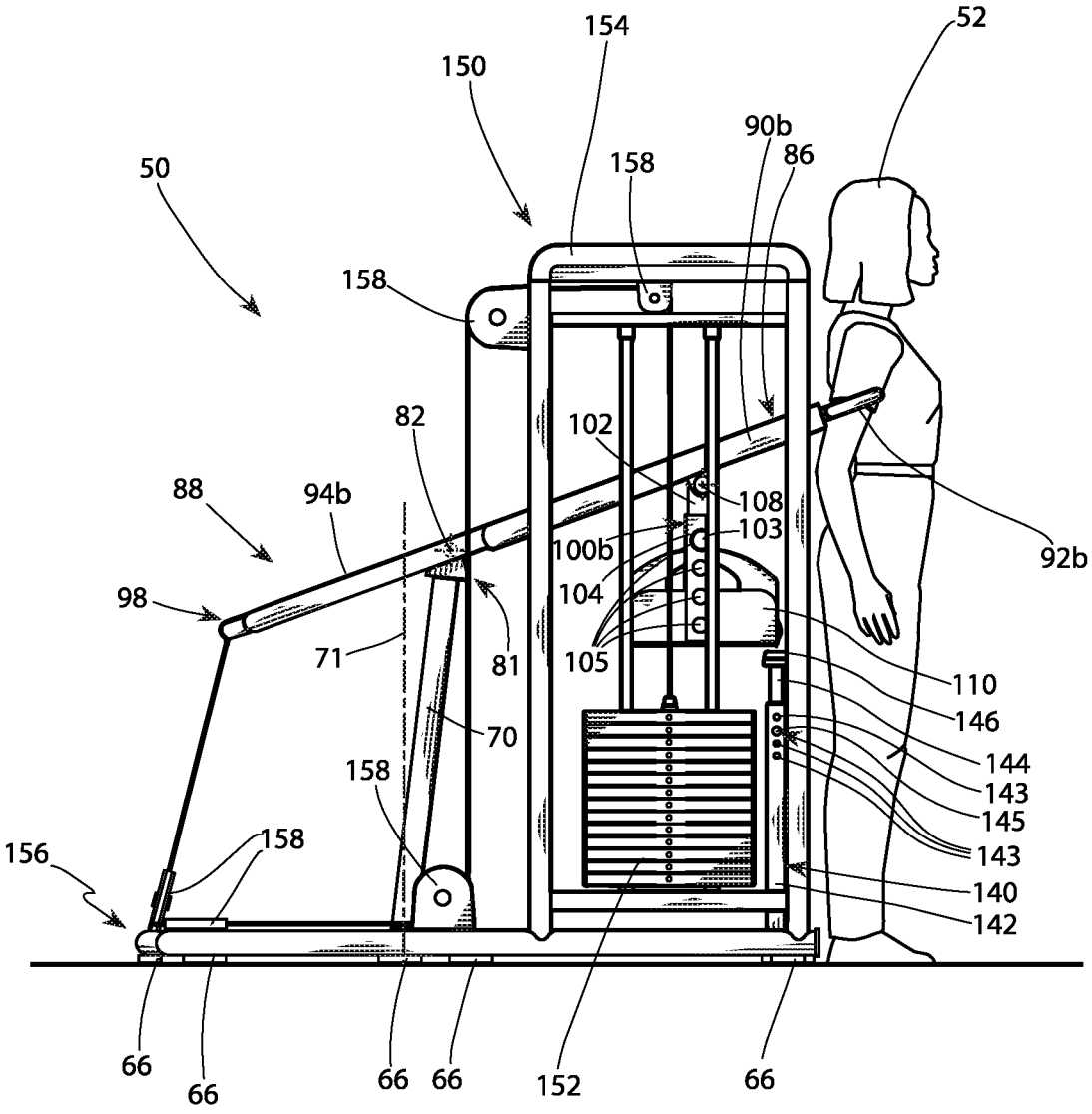
FIG. 3A is a right side elevation view of the exercise apparatus of FIG. 1 in an initial position with the user of FIG. 2 standing in front of the exercise apparatus.
Figure 3B:
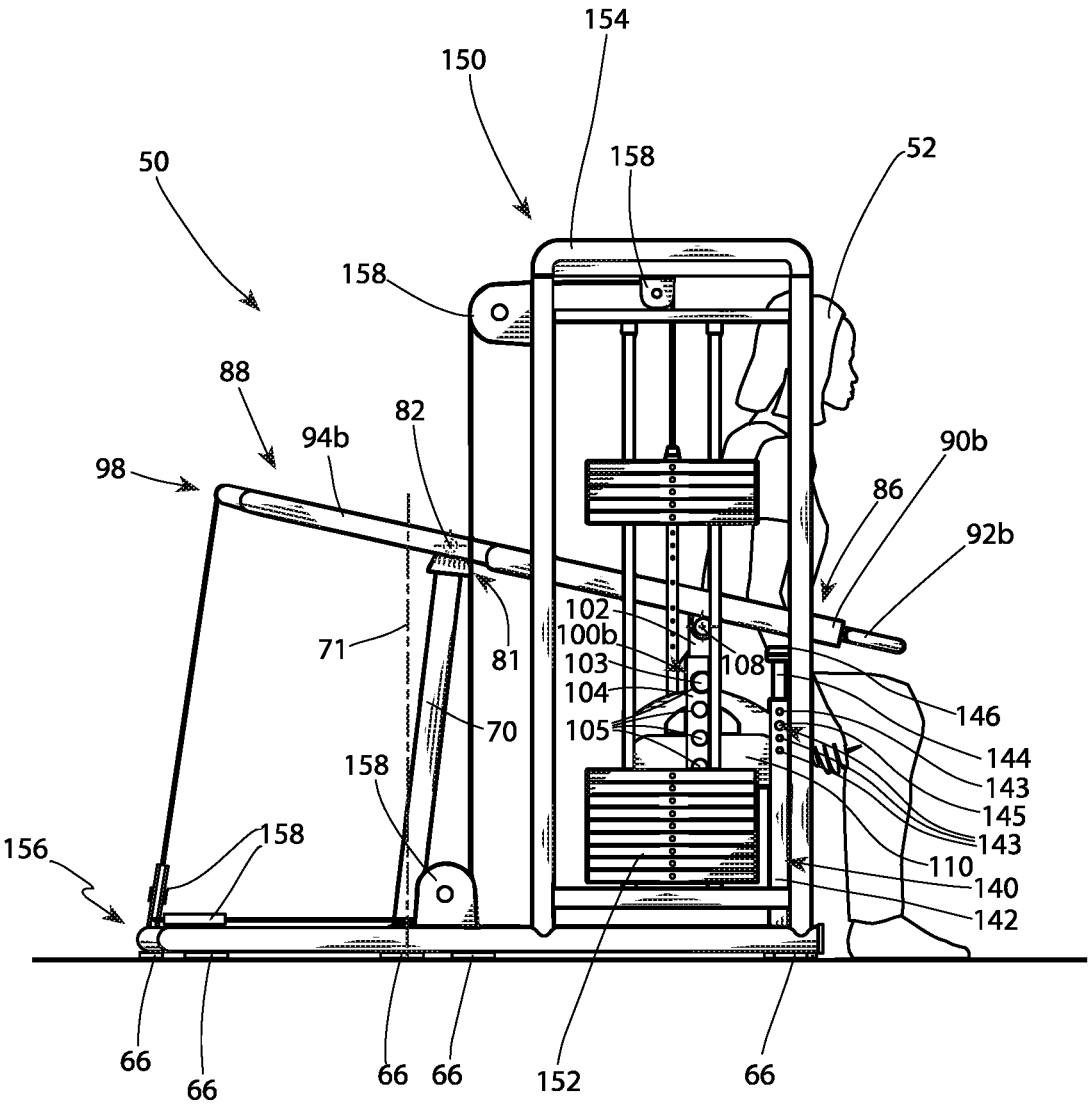
FIG. 3B is a right side elevation view of the exercise apparatus of FIG. 1 being used by the user of FIG. 2, the exercise apparatus being in a lower position.

Referring to FIGS. 1, 3A and 3B, the exercise apparatus 50 includes a stopper 140 configured to stop the pivotal motion of the lever 80 at a selectively chosen position. In some embodiments, the selectively chosen position defines the lower position. The stopper 140 extends upward from a front end of the right base portion 62*b*. It is contemplated that in some embodiments, the stopper 140 could extend upward from the left base portion 62*a*. The stopper 140 has a lower portion 142 and an upper portion 144 that is configured to be received in the lower portion 142 (i.e., the stopper 140 has a telescopic configuration). The lower portion 142 defines four apertures 143. It is contemplated that in some embodiments, the lower portion 142 could define more or fewer than four apertures 143. The upper portion 144 has an abutting member 146. In the present embodiment, as will be described in greater detail below, the abutting member 146 is configured to abut the left lever arm 90*a* when the lever 80 reaches the selectively chosen position. The upper portion 144 also has a retractable pin 145 that is configured to extend through the four apertures 143 and that is biased toward an extended position.

The stopper 140 is selectively adjustable. More precisely, a vertical position of the abutting member 146 can be adjusted by retracting the retractable pin 145, and moving the upper portion 144 vertically up or vertically down, as desired, relative to the lower portion 142, until the retractable pin 145 is aligned with one of the apertures 143. When the retractable pin 145 is aligned with the one of the apertures 143, the retractable pin 145 extends through the one of the apertures 143, since the retractable pin 145 is biased toward the extended position.

The exercise apparatus 50 also includes a counterweight assembly 150 that is disposed on the right of the right base portion 62*b* (i.e., on a right side of the seat 110). The counterweight assembly 150 includes a weight stack 152 made of a plurality of weight plates and a support structure 154 supporting the weight stack 152. The support structure 154 is connected to the base 60. The support structure 154 also has feet 66. The counterweight assembly 150, which is operatively connected to the lever 80 to bias the lever 80 towards the initial position, is connected to the lever 80 by the connecting segment 98 and a pulley system 156. Thus, the counterweight assembly 150 is connected to the rear lever portion 88. The pulley system 156 includes five pulleys 158. It is contemplated that in other embodiments, the pulley system 156 could include more or fewer than five pulleys. As will be described in greater detail below, the counterweight assembly 150 is configured to bias the lever 80 toward the initial position. The counterweight assembly 150 is also configured so that only a selected number of weight plates from the weight stack 152 biases the lever 80 towards the initial position. It is contemplated that in other embodiments, the lever 80 could be biased toward the initial position differently. For example, the lever 80 could be biased by resistance bands or springs and/or by weights, such as weight plates, suspended from the connecting segment 98.

Thus, the lever 80 is moveable between the initial position and the lower position by applying a downward force on the seat 110 and/or the handles 92*a*, 92*b*, and/or any part of the front lever portion 86. At the initial position, the lever 80 is at rest and the seat 110 is at an initial seat height. At the lower position, the lever 80 abuts the stopper 140, the seat 110 is at a lower seat height, and the lever 80 is biased toward the initial position by the counterweight assembly 150. At any position between the initial and lower positions, the lever 80 is biased toward the initial position by the counterweight assembly 150.

It is contemplated that in some implementations of the present technology, the lever 80 may be provided with only one front lever arm. In such implementations, the exercise apparatus 50 has a single seat arm connected to the one front lever arm. The seat 110 is connected to the single seat arm, and extends on one side of the single seat arm.

Referring to FIGS. 3A, 3B, 4A, 4B, 5A and 5B, the exercise apparatus 50 as being used by the user 52 will now be described. The user 52 will be described as performing a conventional squat, but it is contemplated that the user 52 could perform other lower body exercises such as pistol squats (i.e., one-legged squats) without departing from the scope of the present technology.

Figure 4A:
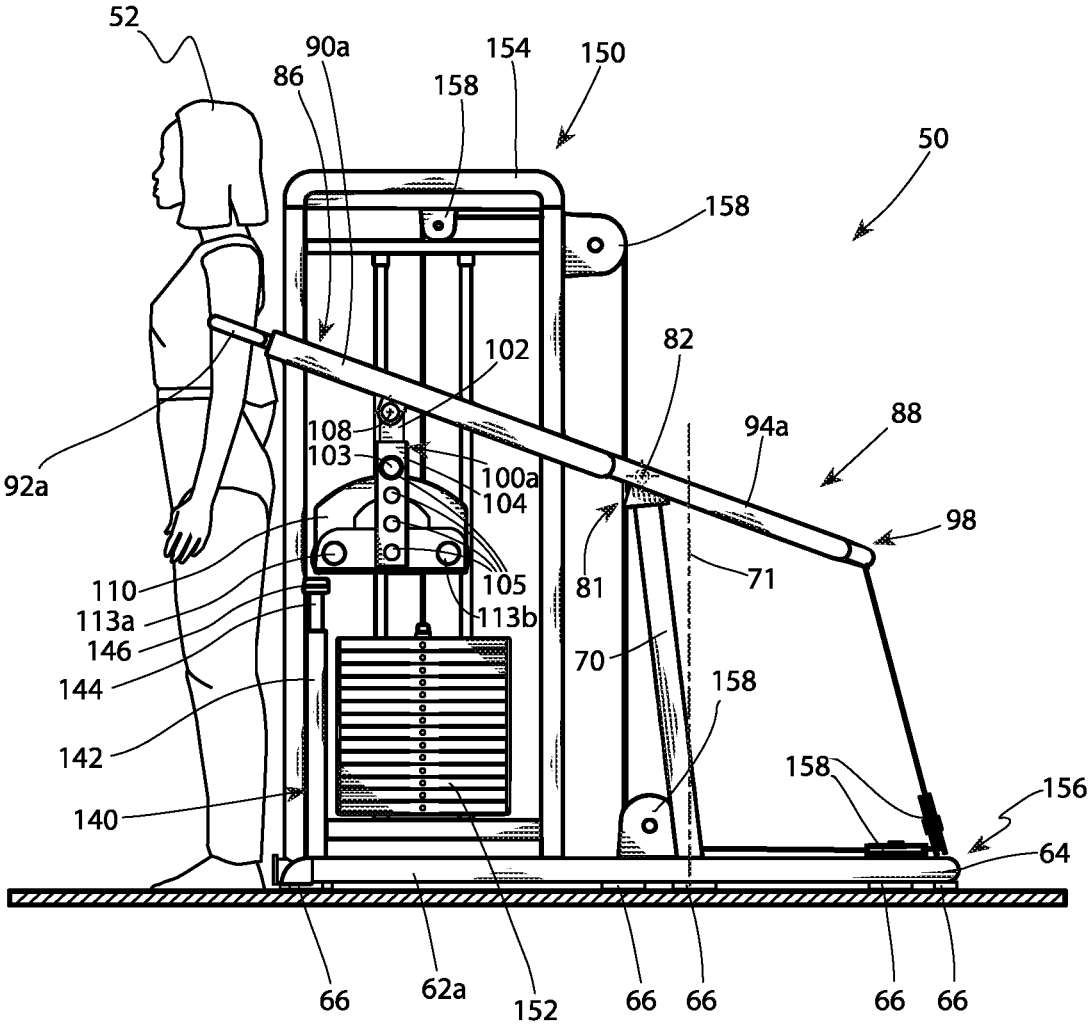
FIG. 4A is a left side elevation view of the exercise apparatus of FIG. 1 in the initial position and the user of FIG. 2 standing in front of the exercise apparatus.
Figure 5A:
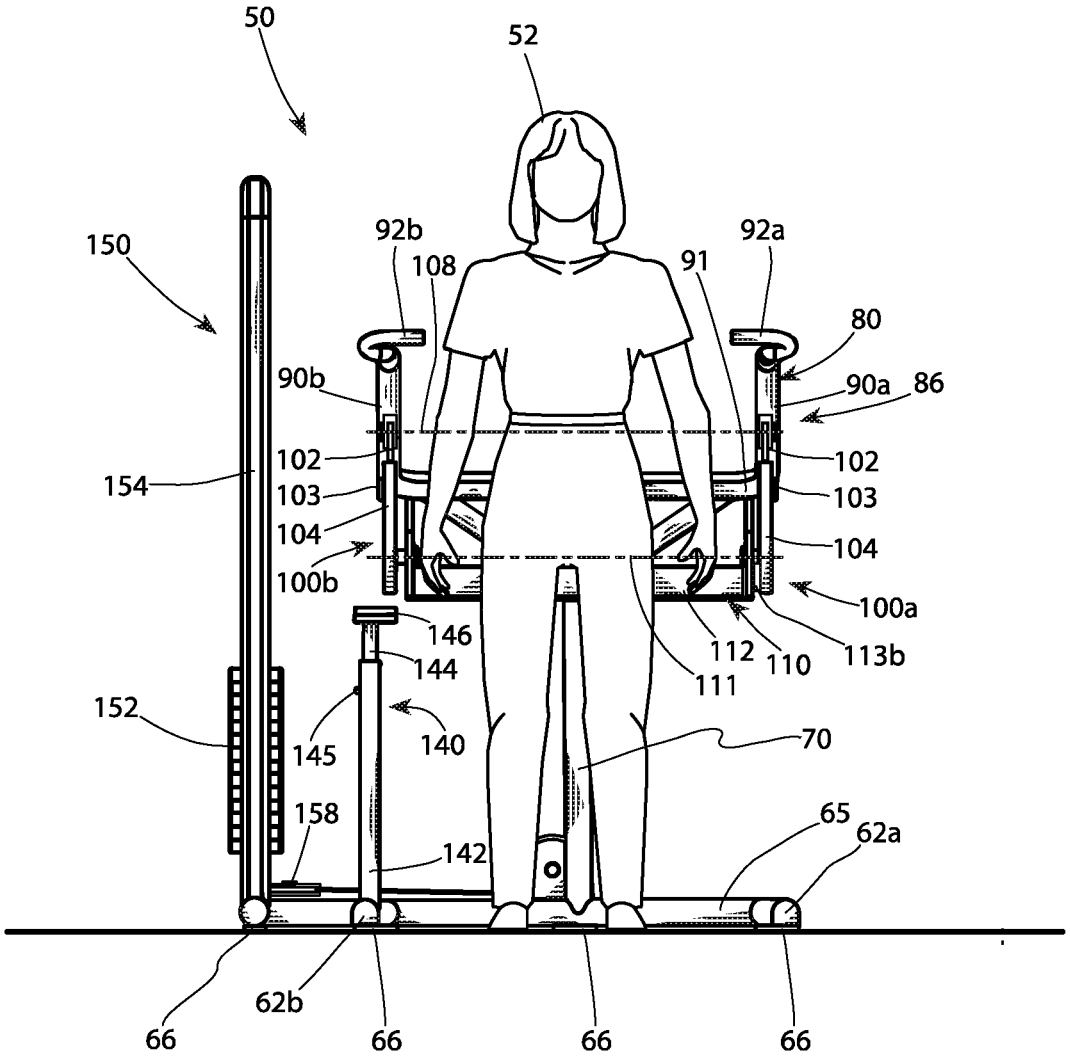
FIG. 5A is a front elevation view of the exercise apparatus of FIG. 1 in the initial position and the user of FIG. 2 standing in front of the exercise apparatus.

Focusing on FIGS. 3A, 4A and 5A, the user 52 is initially standing longitudinally forward from the exercise apparatus 50, laterally aligned with the seat 110. The spacing between the left and right base portion 62*a*, 62*b* and the configuration of the seat 110 is such that the seat 110 extends between the left and right base portions 62*a*, 62*b*. This provides clearance for the feet of the user 52. Additionally, this provides clearance for use of various equipment such as squat wedges. The exercise apparatus 50 has been adjusted for the user 52. Notably, the length of the left and right seat arms 100*a*, 100*b* has been adjusted to accommodate for a height of the user 52. Specifically, the length of the left and right seat arms 100*a*, 100*b* has been adjusted so that a vertical distance between the top of the seat 110 and the resting surface is generally similar to a vertical distance between a posterior of the user 52 and the resting surface (i.e., top of the seat 110 is generally vertically aligned with the posterior of the user 52). Thus, a distance between the top of the seat 110 and the front lever portion 86 is adjusted. As a result, the user 52 can comfortably be seated on the seat 110 while performing the squat. Additionally, the height of the abutting member 146 has been adjusted in accordance to the desired range of motion of the user 52. Furthermore, depending on the degree of assistance required by the user 52, a biasing weight has been selected (i.e., by selecting a corresponding number of weight plates from the weight stack 152). Selecting a higher biasing weight results in a stronger biasing force being applied to the lever 80, and therefore a higher degree of assistance.

Then, the user 52 begins to squat. As the user 52 begins a controlled descent phase of the squat by bending his/her knees, the posterior of the user 52 eventually engages the seat 110. As the selected biasing weight is less than a weight applied by the user 52 on the seat 110, the seat 110 moves down, causing the lever 80 to pivot about the lever pivot axis 82 such that front lever portion 86 moves in a downward direction and the rear lever portion 88 moves in an upward direction. When the lever 80 has moved from the initial position, the selected biasing weight biases the lever 80 toward the initial position. This eases the physical effort required by the user 52 during the controlled descent phase, as the muscles activated during the controlled descent phase are subjected to a lesser load than body weight squats since the selected biasing weight counteracts the weight of the user 52. Additionally, since the seat 110 is free to pivot about the seat pivot axis 108 and can pivot about the seat pivot axis 111, the user 52 can squat without the exercise apparatus 50 causing the user 52 to compromise squat form. Although the seat pivot axis 108 moves along an arcuate path as the lever 80 pivot, since the seat 110 is free to pivot about the seat pivot axis 108, the seat 110 can move along a generally vertical path.

Figure 4B:
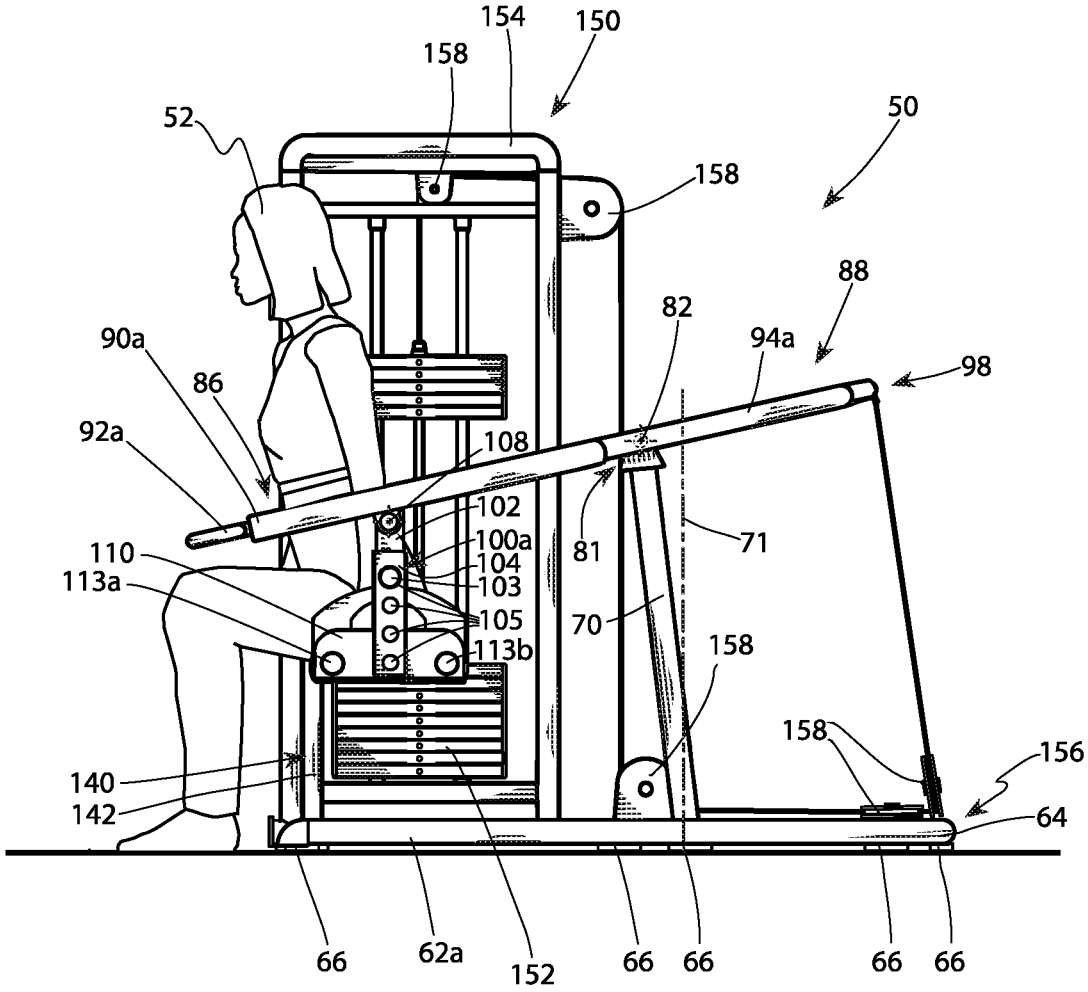
FIG. 4B is a left side elevation view of the exercise apparatus of FIG. 1 being used by the user of FIG. 2, the exercise apparatus being in a lower position.
Figure 5B:
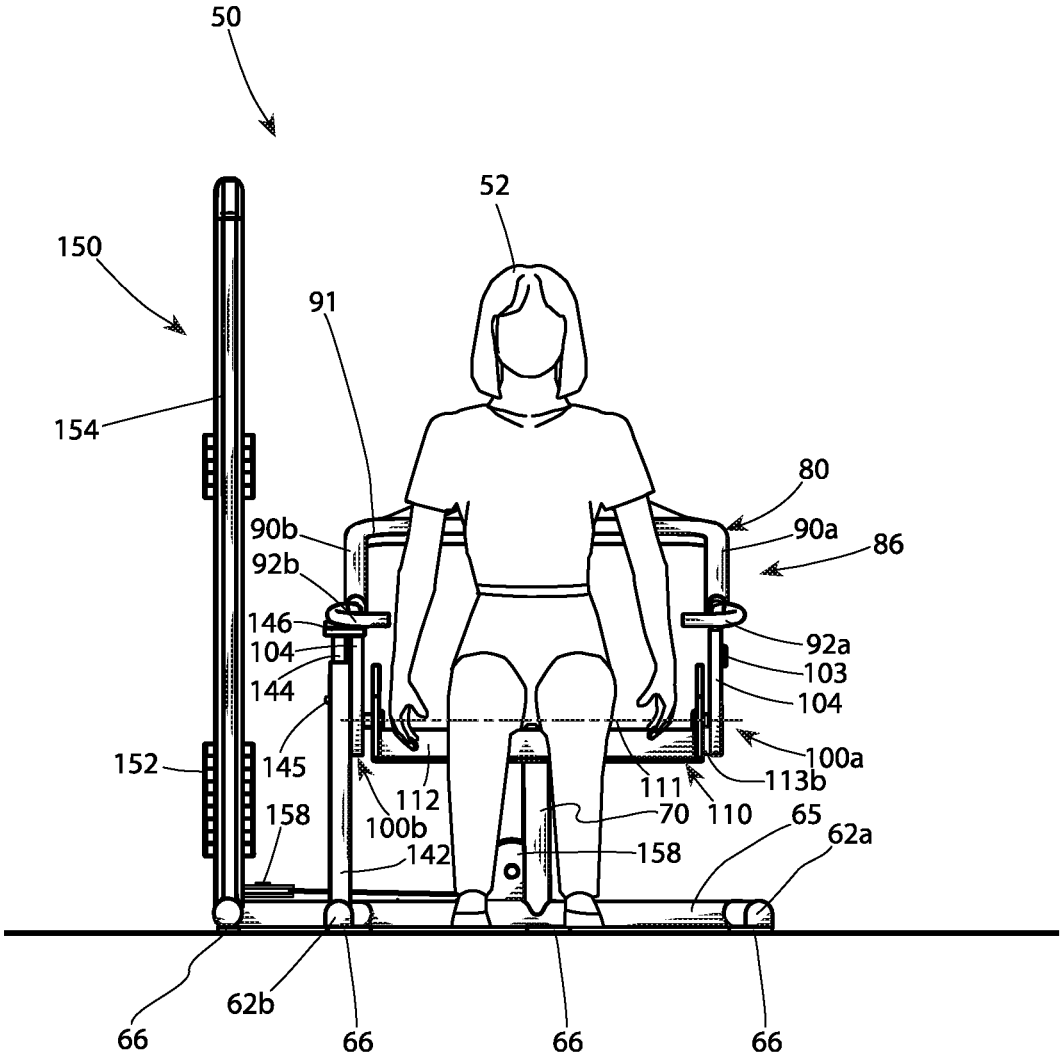
FIG. 5B is a front elevation view of the exercise apparatus of FIG. 1 being used by the user of FIG. 2, the exercise apparatus being in a lower position.

Eventually, as shown in FIGS. 3B, 4B and 5B, the user 52 reaches a lower squat position. In this embodiment, due to the adjustment done to the stopper 140, the lower squat position of the user 52 coincides with when the abutting member 146 of the stopper 140 abuts the left lever arm 90*a*. Thus, the lower squat position of the user 52 coincides with the lower position of the lever 80. It is contemplated that in some embodiments, the lower squat position of the user 52 could be above the lower position of the lever 80, such that the abutting member 146 does not abut the left lever arm 90*a* as the user 52 is squatting.

After reaching the lower squat position, the user 52 begins the controlled ascent phase of the squat by unbending his/her knees to gradually go back to a standing position. The physical effort required by the user 52 to ascend is reduced due to the biasing forces resulting from the selected biasing weight. Once more, since the seat 110 is free to pivot about the seat pivot axis 108 and can pivot about the seat pivot axis 111 enables the user 52 to complete the ascending motion without the exercise apparatus 50 causing the user 52 to compromise squat form.

Eventually, referring back to FIGS. 3A, 4A and 5A, the posterior of the user 52 disengages the seat 110. This coincides with the lever 80 reaching back to the initial position. In some embodiments, the user 52 may perform additional squat repetitions without the lever 80 reaching the initial position.

Over a number of training sessions with the exercise apparatus 50, as the muscles of the user 52 are strengthened, the selected biasing weight can be reduced until body weight exercises can be done without any biasing weight.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. An exercise apparatus comprising:

a base;

a support extending upward from the base;

a lever pivotally connected to the support about a first horizontal pivot axis, the lever having:

a first portion extending at least in part on a first side of the first horizontal pivot axis; and a second portion extending at least in part on a second side of the first horizontal pivot axis;

at least one seat arm having an upper portion connected to the first portion of the lever;

a seat connected to a lower portion of the at least one seat arm, the seat being pivotally connected to the first portion of the lever about a second horizontal pivot axis via the at least one seat arm, the second horizontal pivot axis being parallel to the first horizontal pivot axis, the lever selectively pivoting about the first horizontal pivot axis between a first position and a second position, the seat being higher in the first position of the lever than in the second position of the lever, the lever being biased toward the first position.

2. The exercise apparatus of claim 1, wherein the upper portion of the at least one seat arm is pivotally connected to the first portion of the lever about the second horizontal pivot axis.

3. The exercise apparatus of claim 1, wherein:

the first portion of the lever has a first lever arm and a second lever arm;

the at least one seat arm includes a first seat arm connected to the first lever arm and a second seat arm connected to the second lever arm;

the seat is connected to the lower portions of the first and second seat arms; and the seat is disposed between the first and second seat arms.

4. The exercise apparatus of claim 1, further comprising two handles connected to one of the first portion of the lever and the seat.

5. The exercise apparatus of claim 4, wherein the two handles are connected to the first portion of the lever.

6. The exercise apparatus of claim 1, further including a biasing assembly operatively connected to the second portion of the lever for biasing the lever toward the first position.

7. The exercise apparatus of claim 6, wherein the second portion of the lever is operatively connected to the biasing assembly by a pulley system.

8. The exercise apparatus of claim 6, wherein the biasing assembly is a counterweight assembly.

9. The exercise apparatus of claim 8, wherein the counterweight assembly is disposed on the first side of the horizontal pivot axis, and to a side of the seat.

10. The exercise apparatus of claim 1, wherein a vertical distance between a top of the seat and the first portion of the lever is selectively adjustable.

11. The exercise apparatus of claim 1, further comprising a stopper for stopping the lever at the second position.

12. The exercise apparatus of claim 11, wherein the stopper is selectively adjustable to adjust a location of the second position.

13. The exercise apparatus of claim 11, wherein the stopper abuts the first portion of the lever when the lever reaches the second position.

14. The exercise apparatus of claim 11, wherein the stopper extends upward from the base.

15. The exercise apparatus of claim 1, wherein:

the base has a first base portion, a second base portion and a third base portion, the second base portion being arcuate and extending between the first and third base portions, and the first, second and third base portions defining a U-shape.

16. The exercise apparatus of claim 15, wherein a distance between the first and second base portions is greater than a width of the seat.

17. The exercise apparatus of claim 15, wherein the support extends generally vertically from a fourth base portion that is generally perpendicular to the first and third base portions.

18. The exercise apparatus of claim 1, wherein:

the first portion has an intermediate member extending generally parallel to the first horizontal pivot axis, the second portion has a third arm and a fourth arm, and the third and fourth arms are connected to the intermediate member and to one another for generally defining a triangle.

19. The exercise apparatus of claim 1, wherein the seat is pivotally connected to the lower portion of the at least one arm about a third horizontal pivot axis.

20. The exercise apparatus of claim 19, wherein the seat includes at least one abutting pin for limiting a pivoting range of motion of the seat about the third horizontal pivot axis.

* * * * *